United States Patent [19]

Kan

[11] Patent Number: 4,630,653

[45] Date of Patent: Dec. 23, 1986

[54] WASTE TONER COLLECTING APPARATUS

[75] Inventor: Yuji Kan, Hyogo, Japan

[73] Assignee: Sanyo Electric Co., Ltd., Japan

[21] Appl. No.: 693,868

[22] Filed: Jan. 23, 1985

[30] Foreign Application Priority Data

May 17, 1984 [JP] Japan ..... 59-72682[U]

[51] Int. Cl.[4] ..... B65B 1/04

[52] U.S. Cl. ..... 141/83; 141/256; 141/351

[58] Field of Search ..... 141/83, 250–284, 141/348–362

[56] References Cited

FOREIGN PATENT DOCUMENTS 372735 4/1923 Fed. Rep. of Germany ..... 141/256

*Primary Examiner*—Houston S. Bell, Jr.
*Attorney, Agent, or Firm*—Darby & Darby

[57] ABSTRACT

A waste toner collecting apparatus includes a first cylindrical member for receiving a waste toner scraped off from a photosensitive member, and a screw conveyor housed by the first cylindrical member for conveying the waste toner. A first opening is formed at a downstream side of the screw conveyor of the first cylindrical member. A second cylindrical member is fitted onto an outer circumference of the first cylindrical member, and a second opening is formed thereon at a part corresponding to the first opening and an engaging portrusion is formed outside thereof. A waste toner container is mounted in a free engagement in such in way that a cylindrical portion thereof surrounds the second cylindrical member and a rib engageable with the engaging protrusion of the second cylindrical member is formed thereon. In the case where the protrusion of the second cylindrical member is engaged with the rib of the waste toner container, two openings formed in the cylindrical members are aligned and therefore the waste toner is able to be collected into the waste toner container. When the protrusion and the rib are disengaged from each other, the two openings are in different positions and therefore the first opening is closed or shut off by the second cylindrical member.

11 Claims, 10 Drawing Figures

WASTE TONER COLLECTING APPARATUS

BACKGROUND OF THE INVENTION

1. Field of the Invention

The present invention relates to a waste toner collecting apparatus. More specifically, the present invention relates to a waste toner collecting apparatus for use with equipment for forming a visible image by using a toner, for example, such as an electrophotographic copying machine.

2. Description of the Prior Art

For example, in an electrophotographic copying machine, a toner image formed on a photosensitive member is transferred on a copying paper, but such a transfer is often incomplete and some toner remains on the photosensitive member. Accordingly, a cleaning apparatus for cleaning such remaining toner is provided in conventional electrophotograpic copying machines and the waste toner removed by the cleaning apparatus is collected in a waste toner container. Such waste toner container is normally provided in conjunction with the cleaning apparatus, but there is a possibility that the waste toner will leak from the mounting or connecting parts thereof when removing the cleaning apparatus.

A developing apparatus which is capable of solving the problem of leaking toner when supplying the toner has been disclosed, for example, in Japanese Utility Model Publication No. 7964/1981 published on Feb. 21, 1981. However, what is disclosed in the Japanese publication is the developing apparatus which is not applicable just as it is in the cleaning apparatus and the waste toner collecting apparatus related thereto.

SUMMARY OF THE INVENTION

Therefore, it is a principal object of the present invention to provide a waste toner collecting apparatus that minimizes the possibility of toner leakage when, for example, dismounting a waste toner container.

In brief, the present invention is the waste toner collecting apparatus which comprises a waste toner passageway for receiving and conveying the waste toner scraped off from the photosensitive member, a first opening formed at the downstream side of the conveying passageway of the waste toner, a cover member disposed in conjunction with the conveying passageway and adapted to be positioned in first and second states, a second opening which is in communication with the first opening when the cover member is in the first state, and a removable waste toner container which communicates with the first opening. When the cover member and the waste toner container are in a proper engagement the cover member is in the first state and the first and second openings are aligned with each other when the cover member and container are not engaged, the first and second openings will be in different positions respectively and the first opening will be effectively closed.

According to the present invention, when the waste toner container is disengaged, for example, by removing the container from the copying machine or the like, the first opening will be closed by the cover member thereof. Accordingly, there is hardly any possibility that the toner will leak when removing the waste toner container.

In the preferred embodiment of the present invention, a weight detecting apparatus capable of detecting a weight is provided in conjunction with the waste toner container. The fact that the waste toner collected more than the predetermined amount in the waste toner container is detected by the weight detecting apparatus. The weight detecting apparatus may be used to trigger an alarm or indicator to indicate when it is time to empty the waste toner container.

These objects and other objects, advantages, aspects and features of the present invention will become more apparent from the following detailed description when taken in connection with the accompanying drawings.

DESCRIPTION OF THE PREFERRED EMBODIMENTS

Figure 1:
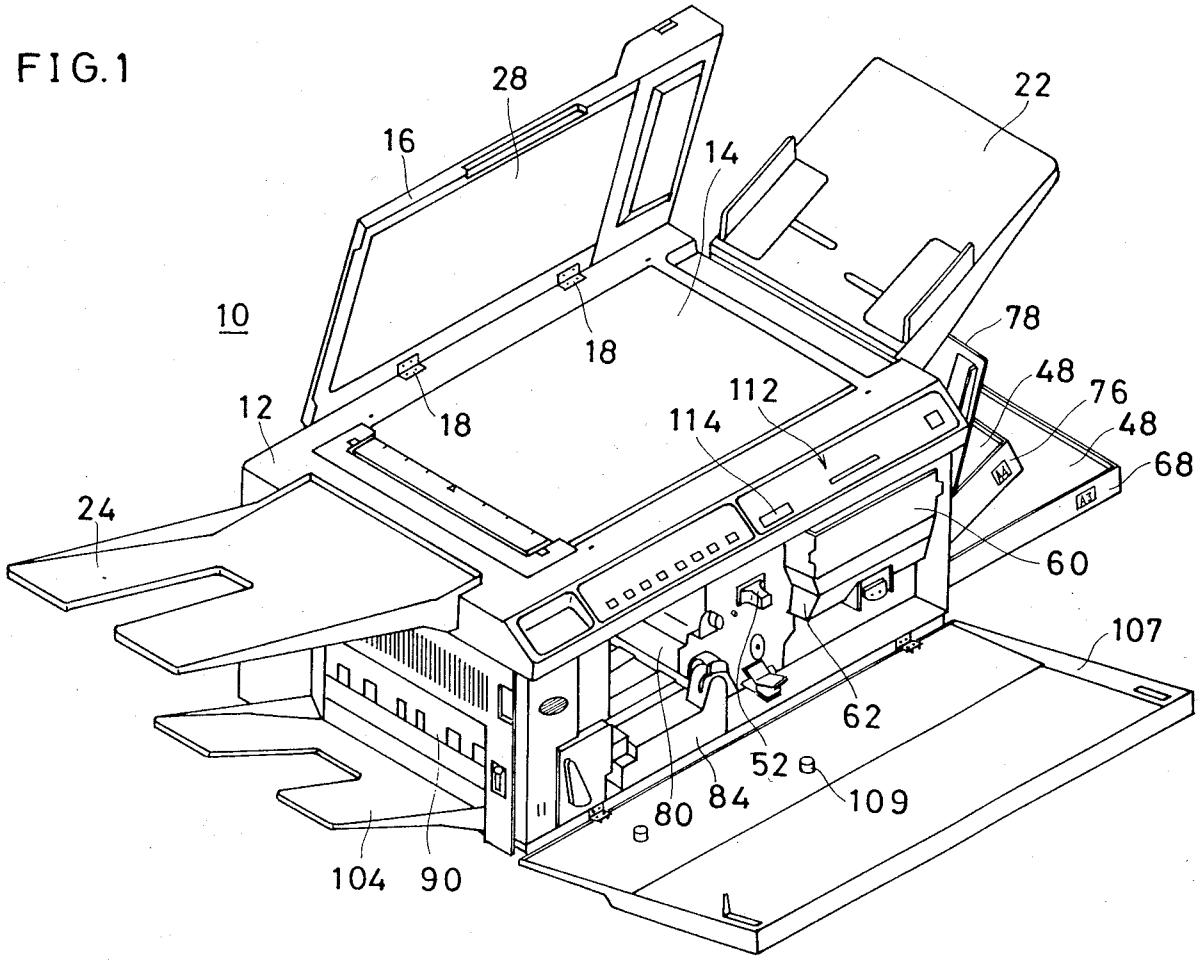
FIG. 1 is a perspective view showing an electrophotographic copying machine as an embodiment of the present invention.
Figure 2:
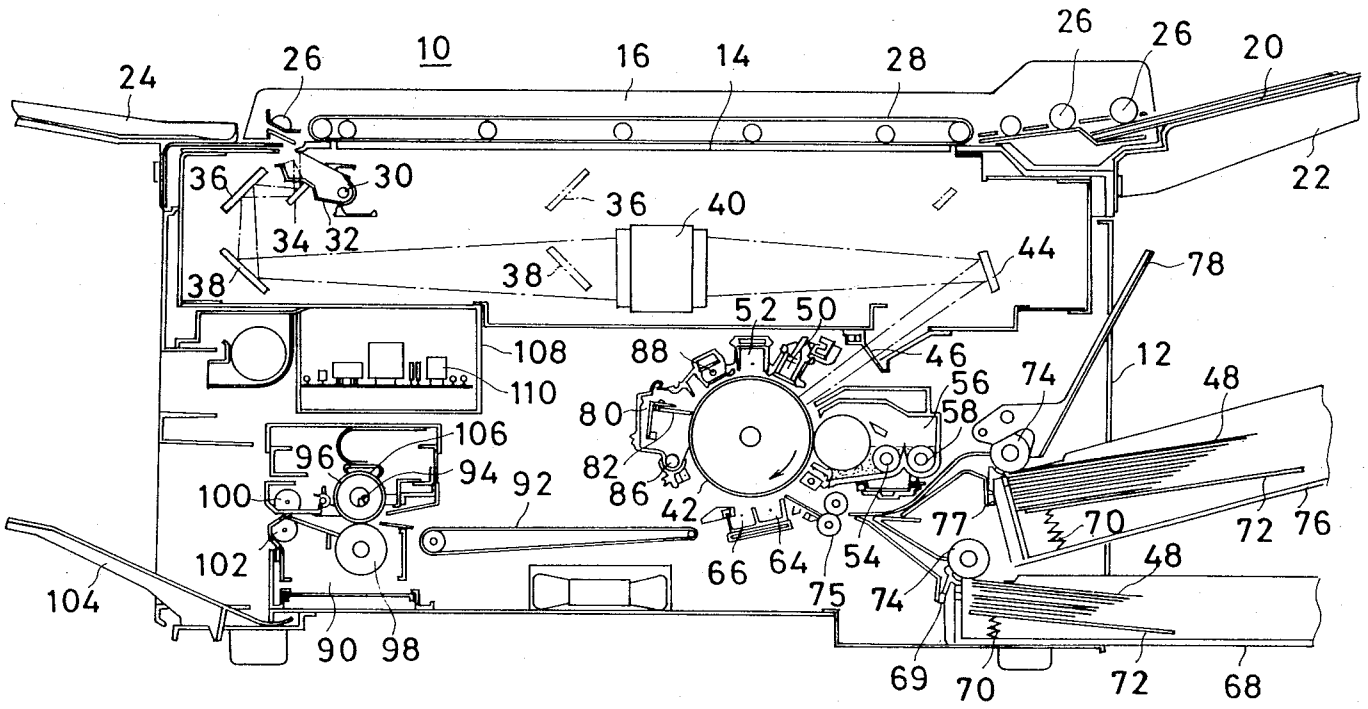
FIG. 2 is a sectional illustrative view for explaining an internal structure of FIG. 1.

FIG. 1 is a perspective view showing an electrophotographic copying machine as one embodiment in accordance with the present invention, and FIG. 2 is a cross-sectional illustrative view for explaining the inner structure thereof. Hereinafter, the present invention is described as an application to an electrophotographic copying machine, and it is pointed out in advance that the present invention can be applied also to image forming apparatuses other than such an electrophotographic copying machine, for example, the printer, facsimile and the like.

In reference to FIG. 1 and FIG. 2, an electrophotographic copying machine 10 includes a copying machine main body 12, and on the top surface of this copying machine main body 12, an original table 14 composed of a transparent glass plate is installed in a fixed fashion. On the upper part of this original table 14, an automatic document feeder 16 is mounted by means of hinges 18 at the side end thereof. At the leading end side of this automatic document feeder 16, an original placing table 22 whereon originals 20 before copying are stocked is provided, and at the trailing end side of the automatic document feeder 16, a tray 24 receiving originals after copying is provided. The automatic document feeder 16 includes a plurality of rollers 26, 26 . . . and an endless belt 28 for picking up and carrying the original copies 20 placed on the original placing table 22.

Under the original table 14 in the copying machine main body 12, a light source 30 as a scanning means for exposing and scanning the original is installed, and this light source 30 is made movable from one end side to the other end side of the original table 14 and in the reverse direction thereto. Then, the movement in the right-left direction of this light source 30 is achieved by driving by means of a servo motor (not illustrated). Associated with the light source 30, a reflecting mirror 32 having elliptic cross-section is provided. A first movable mirror 34 is fixed to this reflecting mirror 32. When the light source 30 goes in the right direction in FIG. 2 by means of the servo motor, the original placed on the original table 14 is exposed through a slit, and such an exposure is not performed when the light source 30 returns in the left direction in FIG. 2.

Associated with the first movable mirror 34, a second movable mirror is provided, and this second movable mirror comprises a pair of movable mirrors 36 and 38. This pair of movable mirrors 36 and 38 are for reflecting again the original image reflected by the first movable mirror 34 toward an image-forming lens 40. These second movable mirrors 36 and 38 can be moved in the same direction as that of this light source 30 at a speed of ½ of the moving speed of the light source 30. Meanwhile, the image-forming lens 40 is constituted with a zoom lens, and accordingly, the electrophotographic copying machine of the present embodiment can change the copy magnification.

In front of the image-forming lens 40, a fixed reflecting mirror 44 for reflecting the original image transmitted through the lens 40 toward a photosensitive drum 42 is installed. And, an infrared absorbing filter 46 is inserted between this fixed reflecting mirror 44 and the photosensitive drum 42.

A side erase lamp 50 is provided at an upstream side of the exposure position of the photosensitive drum 42, that is, the position where the original image is produced by the reflecting mirror 44, and this side erase lamp 50 is for removing charges on the portion corresponding to the side edge part of the copy paper on the photosensitive drum 42. At a further upstream side of this side erase lamp 50, a charging corotron 52 for uniformly accumulating charges of a specific polarity on the photosensitive drum 42 is installed.

A developing apparatus 56 is installed at a downstream side of the above-mentioned exposure position of the photosensitive drum 42, and an electrostatic latent image formed on this photosensitive drum 42 by the charging corotron 52, the light source 30 and the image-forming lens 40 is developed by this developing apparatus 56. The developing apparatus 56 includes a toner container 60 (FIG. 1) for feeding a toner, and associated with this toner container 60, the developing apparatus 56 further includes screw conveyors 54 and 58. These screw conveyors 54 and 58 are for stirring a carrier and the toner. Meanwhile, the toner container 60 is mounted in a manner that it can swing back and forth with a supporting axis 62 (FIG. 1) acting as a fulcrum.

At one side end of the copying machine main body 12, a paper feeding part is formed, and in this paper feeding part, in the present embodiment, two paper feeding cassettes 68 and 76 are loaded in a freely attachable/detachable fashion. In the paper feeding cassette 68, for example, papers 48 of A3 size are stacked, and in the other paper feeding cassette 76, for example, papers 48 of A4 size are stacked. A compression spring 70 and a supporting plate 72 for pushing the stacked papers 48 upward are provided in the inner bottom part of respective paper feeding cassettes 68 and 76. A paper at the top of papers stacked in the paper feeding cassette 68 or 76 is pressed against a paper feeding roller 74 by this spring 70 and the supporting plate 72. The paper feeding roller 74 takes the paper 48 thus pressed one by one in sequence onto a register roller 75 from this paper feeding cassette 68 or 76 by means of rotation thereof. In the present embodiment, a manual paper feeding table 78 is further provided in the paper feeding part, and when this manual paper feeding table 78 is rotated clockwise from a state as shown in FIG. 2 to become a nearly horizontal state, a manual paper feeding can be performed.

Cassette sensors 69 and 77 which can detect the presence of the paper feeding cassettes 68 and 76 in an attached state are provided, respectively. These cassette sensors 69 and 77 respectively include, for example, a microswitch whose actuator is actuated by the paper feeding cassette 68 or 76 in a state loaded in the main body 12.

At the downstream side of the developing apparatus 56, a transferring corotron 64 and a separating corotron 66 are installed in an one-body fashion.

When the paper 48 is fed from the paper feeding cassette 68 or 76, that is, the paper feeding part, a toner image formed on the photosensitive drum 42 is transferred onto the paper 48 by the transferring corotron 64. In transferring by this transferring corotron 64, the paper is attracted to the drum 42, being likely to move together with this drum 42, but it is separated by the separating corotron 66, being carried toward a vacuum conveyor 92 as described later.

A cleaning apparatus 80 is provided at the downstream side (top left in FIG. 2) of the separating corotron 66 along the photosensitive drum 42, and this cleaning apparatus 80 removes the toner which is not transferred completely and remains on the photosensitive drum 42. This cleaning apparatus includes a rubber blade 82 for scraping the toner remaining on the photosensitive drum 42, and the remaining toner scraped off by this blade 82 is sent out to a waste toner container 84 by a screw conveyor 86. The present invention is directed to such a waste toner collecting apparatus.

Furthermore, at the upstream side of the cleaning apparatus 80, a charge-removing lamp 88 for removing the charges remaining on the photosensitive drum 42 is provided, and the above-mentioned charging corotron 52 is disposed at a further downstream side of this charge-removing lamp 88.

The paper separated from the photosensitive drum 42 by the separating corotron 66 is sent to a fixing apparatus 90 by the vacuum conveyor 92. This fixing apparatus 90 includes a heating roller 96 incorporating a heater 94 and a pressure roller 98 for pressure-contacting the paper with this heating roller 96. Accordingly, the toner image transferred on the paper 48 is heated and pressed by the two rollers 96 and 98, being fixed on the paper 48. The paper completing fixation is discharged on a discharged paper tray 104 by means of a pair of paper discharging rollers 100 and 102. In addition, associated with the heating roller 96, and oil supplying part 106 is provided for supplying to the roller 96 with silicone oil.

A control box 108 is formed above the fixing apparatus 90 in the copying machine main body 12, and a component 110 for a control system is provided in this control box 108.

Further, in front of the main body 12 of the electrophotographic copying machine 10, a front door 107 with a lower end thereof supported on hinges is installed. The front door 107 comprises a free opening construction and may be opened for an internal inspection and repair. On an inner surface of the front door 107 and in a position corresponding to the waste toner container 84, for example, a cylindrical protrusion or post 109 is disposed in projection. The post 109, as to be described later, prevents the closure of the front door 107 when the waste toner container 84 is not mounted properly.

As shown in FIG. 1, an indicator 114 is provided on an operation panel 112 of the electrophotographic copying machine 10. The indicator 114 indicates when more than a predetermined quantity of waste toner has been collected in the waste toner container 84 and informs an operator thereof. That is, the indicator 114 may be drived by a CPU (not shown) in response to a signal from a switch 154 (FIG. 9) to be described later.

Figure 3:
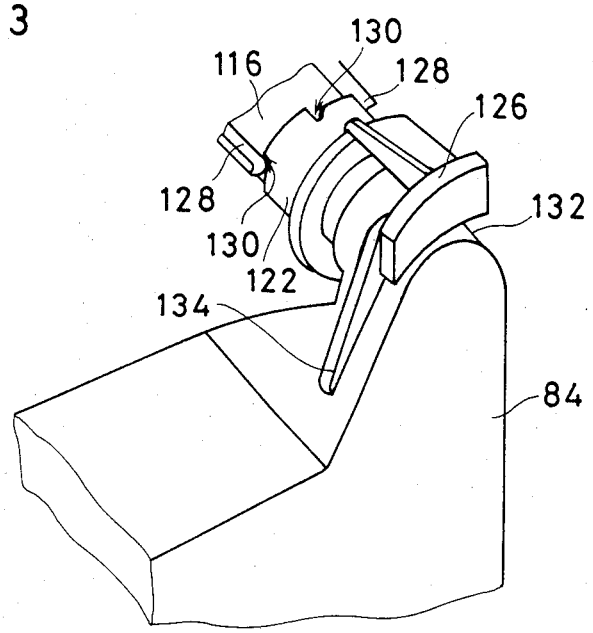
FIG. 3 is a perspective view showing a major portion of the embodiment of the present invention.
Figure 4:
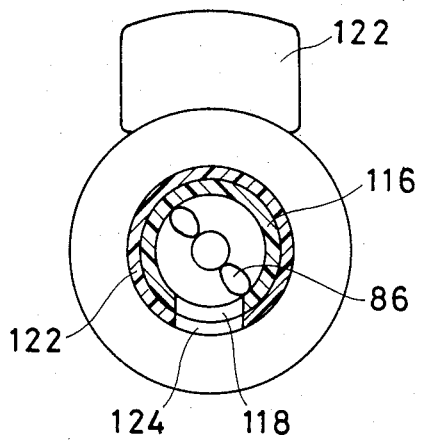
FIG. 4 is a sectional illustrative view of FIG. 3.
Figure 5:
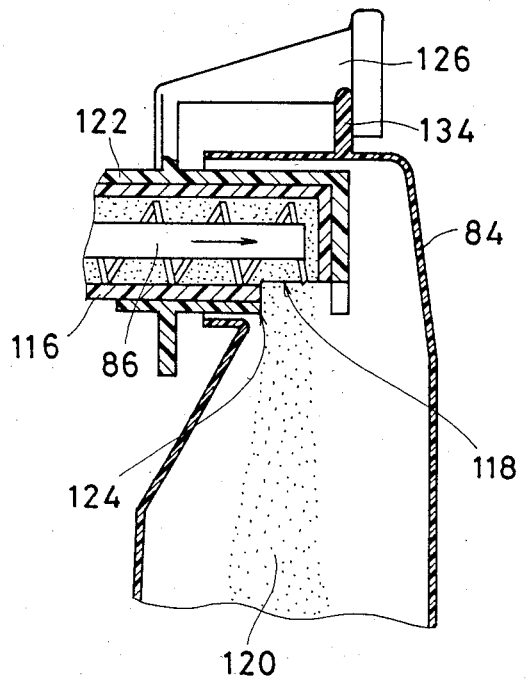
FIG. 5 is a different sectional illustrative view of FIG. 3.

Referring to FIGS. 3, 4 and 5, a first cylindrical body 116 is formed in conjunction with the cleaning apparatus 80 so as to be able to receive the waste toner removed from the photosensitive drum 42. Inside the first cylindrical body 116, as will be apparent, in particular, from FIGS. 4 and 5, the screw conveyor 86 is rotatably installed. Accordingly, according to the rotation of the screw conveyor 86, the waste toner 120 fed into the first cylindrical body 116 may be conveyed in the direction shown by the arrow in FIG. 5. On the lower side wall of the end portion of the first cylindrical body 116 at the downstream side in the conveying direction, as will be apparent, in particular, from FIGS. 4 and 5, a first opening 118 is formed. Accordingly, the waste toner conveyed by the screw conveyor 86 may be discharged to the outside through the first opening 118.

A second cylindrical body 122 is mounted on an external circumference of the end portion of first cylindrical body 116 as a cover member. A second opening 124 corresponding to the first opening 118 of the first cylindrical body 116 is formed on the second cylindrical body 122, which is constructed rotatably in the mounted state onto the first cylindrical body 116. Accordingly, when the second cylindrical body 122 is in a first state, the first and second openings 118 and 124 correspond to each other in position, however, when it is in a second state, the second cylindrical body 122 covers or closes the opening 118 of the first cylindrical body 116. On the outside of the second cylindrical body 122, a T-shaped engaging protrusion 126 extending in an axial direction of the cylindrical body is formed integrally. Moreover, at the upstream side of the second cylindrical body 122 in the conveying direction of the waste toner, a step portion 130 is formed outside the above described cylindrical body 116, which is engageable selectively with an end portion of a protruded rail 128 formed extending along the conveying direction of the waste toner according to the first and the second-states thereof.

The waste toner container 84 comprises a cylindrical portion 132, which is mounted in a free engagement so as to surround the second cylindrical body 122. A rib 134 engageable with a tip of the above described engaging protrusion 126 is formed on the cylindrical portion 132 in projection.

In the states as shown in FIGS. 3–5, the tip of the engaging protrusion 126 of the second cylindrical body 122 and the rib 134 formed on the cylindrical portion 132 of the waste toner container 84 are in engagement. As such, the engagement between the engaging protrusion 126 and the rib 134 means that the cylindrical portion 132 of the waste toner container 84 is properly mounted onto the second cylindrical body 122, and in this state, the first opening 118 of the first cylindrical body 116 and the second opening 124 of the second cylindrical body 122 correspond to each other in position as shown in FIG. 4. Accordingly, the waste toner 120 being conveyed by the screw conveyor 86 is collected in the waste toner container 84 through the two openings 118 and 124 as shown in FIG. 5.

Figure 6:
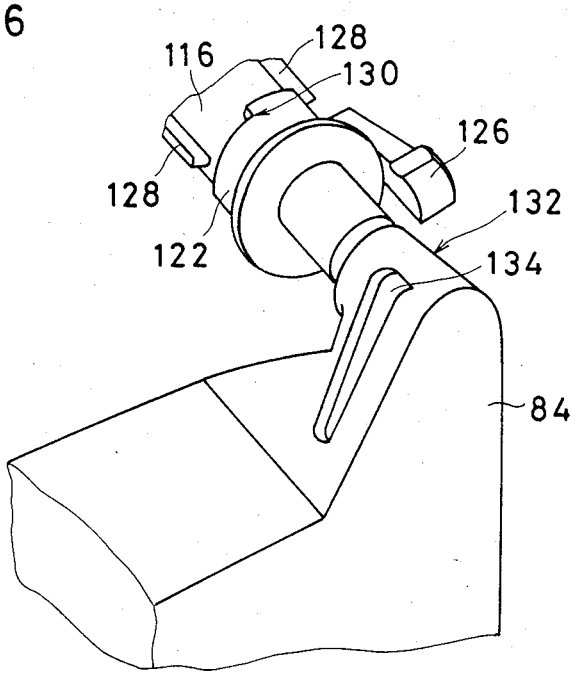
FIG. 6 is a perspective view of a major portion showing a state different from FIG. 3.
Figure 7:
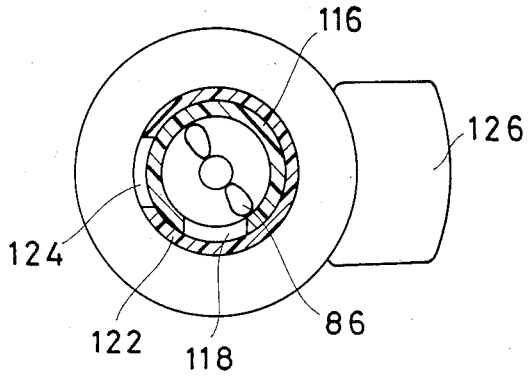
FIG. 7 is a sectional illustrative view corresponding to FIG. 4 in a state in FIG. 6.
Figure 8:
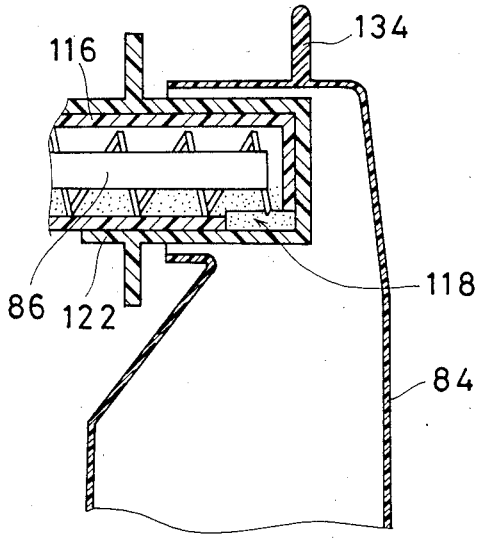
FIG. 8 is a sectional illustrative view corresponding to FIG. 5 in a state in FIG. 6.

In the states shown in FIGS. 6–8, the engaging protrusion 126 and the rib 134 are disengaged. In this state, as shown in FIG. 7, the first and second openings 118 and 124 are positioned in different positions, accordingly the first opening 118 is closed by the side wall of the second cylindrical body 122. As such, when the engaging protrusion 126 and the rib 134 are in disengagement, the first opening 118 is closed and there is hardly any possibility that the waste toner 120 in the first cylindrical body 116 leaks and stains the vicinity.

For mounting the waste toner container 84, the cylindrical portion 132 thereof must be fit onto the outer circumference of the second cylindrical body 122. Then rotate the second cylindrical body 122 to make the first state wherein the step portion 130 engages with the end portion of the protruded rail 128 and the engaging protrusion 126 engages with the rib 134. Then, the first opening 118 is communicated with the second opening 124 and therefore the waste toner 120 can be collected from the first cylindrical body 116 into the waste toner container 84.

For dismounting the waste toner container 84, first, the second cylindrical body 122 must be rotated to make the second state wherein the step portion 130 disengages with the end portion of the protruded rail 128 and the engaging protrusion 126 disengages with the rib 134. Then, the first opening 118 is closed by second cylindrical body 122 and therefore the waste toner 120 will not leak therefrom undesirably. Thereafter, the cylindrical body 132 of the waste toner container 84 may be removed from the second cylindrical body 122.

In the first state of the second cylindrical body 122 shown in FIG. 4, the front door 107 (FIG. 1) mounted on the main body 12 can be closed. Because, in the state shown in FIG. 4, the engaging protrusion 126 of the second cylindrical body 122 does not contact the post 109 formed on the front door 107. Conversely, in the second state of the second cylindrical body 122 shown in FIG. 7, the engaging protrusion 126 rotated to the front side of the main body 12 contacts the post 109. Accordingly, in this state, the front door 107 will not close completely and a microswitch 154 (FIG. 9) to be described later does not operate, consequently, the copying is impossible. Accordingly, the operator may know that the waste toner container 84 is not mounted properly.

Figure 9:
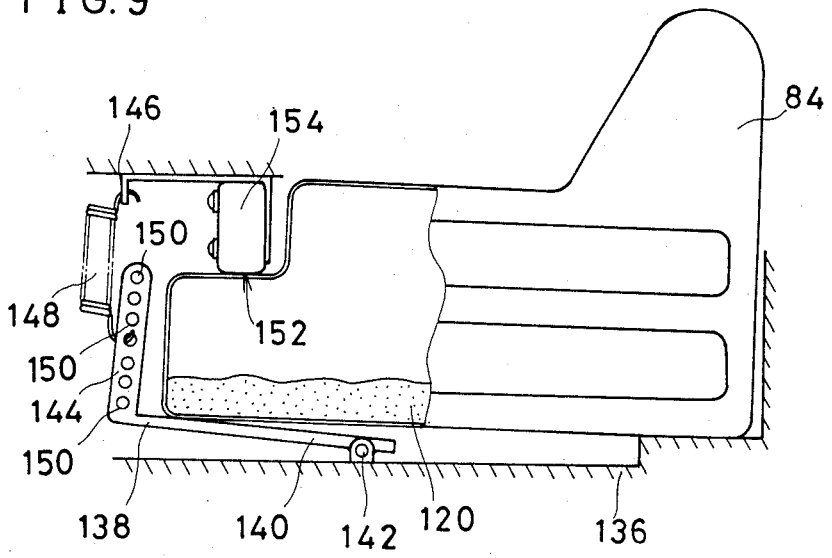
FIGS. 9 and 10 are illustrative views showing a mechanism for detecting a quantity of waste toner.

Next, referring to FIGS. 9 and 10 a detecting mechanism for the quantity of the toner in the waste toner container 84 will be described. One lower end portion (right) of the waste toner container 84 is placed on a base 136 formed on the main body 12 (FIG. 1), while other lower end portion (left) is placed on a long arm side 140 of a L-shaped lever 138. One end of the long arm side 140 of the L-shaped lever 138 is pivotally supported on the base 136 by an axis 142. While, a short arm side 144 of the L-shaped lever 138 is suspended to an upper base 146 via a coil spring 148. More specifically, on the short arm side 144 of the L-shaped lever 138, a plurality of engaging holes 150, 150,—distributed in a longitudinal direction thereof are formed and an other end of the coil spring 148 being hooked by one end to the upper base 146 is engaged to one of the engaging holes 150. Accordingly, by changing the holes 150 to be engaged with the other end of the coil spring 148, a tensile force of the coil spring 148, namely, a detectable weight may be changed or adjusted.

On the upper base 146 in conjunction with a shoulder portion 152 of the waste toner container 84 mounted the microswitch 154 is fixed. An actuator 156 (FIG. 10) of the microswitch 154 is pressed by the shoulder portion 152 of the waste toner container 84 raised by the tensile force of the coil spring 148 when a weight of the waste toner container 84 is light.

Figure 10:
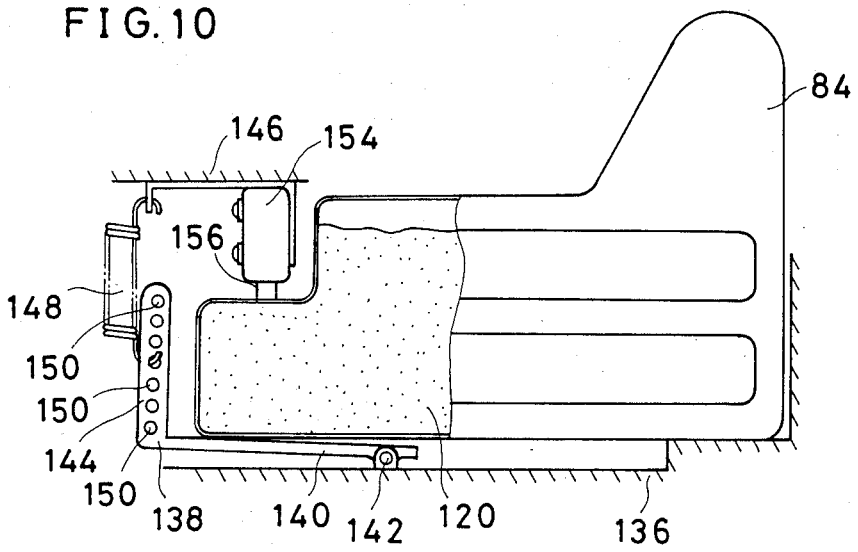

When more than a predetermined amount of waste toner 116 is collected in the waste toner container 84, a total weight of the container 84 increases as shown in FIG. 10. Accordingly, the left end portion of the waste toner container 84 154 descends against the tensile force of the coil spring 148. Then, a pressure on the actuator 156 of the microswitch 154 is released and a signal is provided from the microswitch 154 accordingly. That is, in this state, the signal showing that more than the predetermined amount of waste toner 120 has been collected in the waste toner container 84, is outputted from the microswitch 154. Then, in response to the signal, the indicator 114 (FIG. 1) on the indicating panel of the copying machine 10 indicates the effect and the copying machine becomes non-operative. Accordingly, the operator by confirming the indicator 114, may discharge the waste toner in the waste toner container 84 and empty the container, or replace with a new waste toner container as necessary.

Meanwhile, for informing the operator that more than the predetermined amount of waste toner has been collected, not only the indicator 114 which indicates visually, as described above, but also an audible informing means may be used in place thereof or together.

Furthermore, in the embodiment described above, the waste toner passageway and the cover member comprising the cylindrical body respectively has been described. However, shapes of such waste toner passageway and cover member are not limited to such cylindrical body, but may be changed optionally, for example, such as using a plate type as the cover member. Moreover, it goes without saying that shapes of the engaging protrusion 126 and the rib 134 as the first and second engaging portions may be changed as necessary.

Although the present invention has been described and illustrated in detail, it is clearly understood that the same is by way of illustration and description only and is not to be taken by way of limitation, the spirit and scope of the present invention being limited only by the terms of the appended claims.

What is claimed is:

1. A waste toner collecting apparatus for use in an image forming machine, the image forming machine using a toner for forming an image and having photosensitive means and a toner cleaning apparatus for removing waste toner from the photosensitive means, the waste toner collecting apparatus comprising:

a waste toner container for collecting waste toner;

means defining a passageway adapted to pass waste toner therethrough, the passageway defining means including an elongated, hollow inner tube, the inner tube having opposite ends, a first opening formed near one of its ends and a second opening formed near the other of its ends, the first opening being in communication with the waste toner cleaning apparatus and the second opening being selectively in communication with the toner container; and a hollow outer tube at least partially surrounding at least a portion of the inner tube, the outer tube being adapted to rotate circumferentially about the inner tube between a first position and a second position, the outer tube including a third opening formed therein and situated to be selectively in alignment with the second opening to allow waste toner to flow therethrough and into the waste toner container, wherein the second and third openings are in alignment and the second opening communicates with the toner container when the outer tube is in the first position, and wherein the second and third openings are in non-alignment and the second opening is not in communication with the toner container when the outer tube is in the second position.

2. A waste toner collecting apparatus in accordance with claim 1, which further comprises a first projection extending from said outer tube and a second projection formed on said waste toner container and selectively engageable with said first projection, and wherein the first projection engages said second projection when said outer tube is in said first position and the first projection is disengaged from said second projection when said outer tube is in said second position.

3. A waste toner collecting apparatus in accordance with claim 2, which further comprises a rib formed on said inner tube and a protrusion formed on said outer tube, and wherein said rib and protrusion are in engagement when said outer tube is in said first position.

4. A waste toner collecting apparatus in accordance with claim 1, which further comprises means disposed in the inner tube for effecting movement of waste toner from the first opening to the second opening.

5. A waste toner collecting apparatus in accordance with claim 4, wherein each of said inner and outer tubes are cylindrical in shape, and wherein said waste toner container includes a cylindrical portion which at least partially surrounds at least a portion of said outer tube and guides waste toner therefrom into said waste toner container.

6. A waste toner collecting apparatus in accordance with claim 5, wherein said second opening is formed on a side wall of said inner tube and said third opening is formed on a side wall of said outer tube.

7. A waste toner collecting apparatus for use in an image forming machine, the image forming machine using a toner for forming an image and having photosensitive means and a toner cleaning apparatus for removing waste toner from the photosensitive means, the waste toner collecting apparatus comprising:

a waste toner container for collecting waste toner;

means defining a passageway adapted to pass waste toner therethrough, the passageway defining means including two opposite ends and a first opening formed near one end thereof and communicating with the toner cleaning apparatus, and a second opening formed near the other end thereof and selectively communicating with the waste toner container; and means interposed between the second opening and the waste toner container for selectively controlling the communication between the second opening and the container, the control means being positionable in a first position in which the second opening is in communication with the container, and in a second position in which the second opening is not in communication with the container.

8. A waste toner collecting apparatus in accordance with claim 1, which further comprises means for detecting the weight of said waste toner container, the weight detecting means providing an output signal representative of when the waste toner container exceeds a predetermined weight.

9. A waste toner collecting apparatus in accordance with claim 8, which further comprises means for indicating when said waste toner container exceeds the predetermined weight, the indicating means being responsive to the output signal of said weight detecting means.

10. A waste toner collecting apparatus in accordance with claim 9, wherein said weight detecting means includes a switch.

11. A waste toner collecting apparatus as defined by claim 7, which further comprises means disposed in the passageway for effecting movement of waste toner from the first opening to the second opening.

* * * * *